US005183541A

United States Patent [19]

Snyder et al.

[11] Patent Number: 5,183,541

[45] Date of Patent: Feb. 2, 1993

[54] DECONTAMINATION OF RADIOACTIVE METALS

[75] Inventors: Thomas S. Snyder, Oakmont; William R. Gass, Plum Boro, both of Pa.; Samuel A. Worcester, Butte, Mont.; Laura J. Ayers; Gregory F. Boris, both of Knoxville, Tenn.

[73] Assignee: Westinghouse Electric Corp., Pittsburgh, Pa.

[21] Appl. No.: 769,998

[22] Filed: Oct. 2, 1991

Related U.S. Application Data

[63] Continuation-in-part of Ser. No. 506,044, Apr. 9, 1990.

[51] Int. Cl.[5] ..... C25C 1/06

[52] U.S. Cl. ..... 204/105 R; 204/109; 204/112; 423/11; 423/50

[58] Field of Search ..... 204/105 R, 109, 112; 423/11, 50

[56] References Cited

U.S. PATENT DOCUMENTS

| | | | |
|---|---|---|---|
| 2,450,426 | 10/1948 | Gronningsaeter et al. | 204/11 E |
| 2,733,128 | 1/1956 | Ballard | 204/112 |
| 2,773,820 | 12/1956 | Boyer et al. | 204/105 R |
| 2,776,184 | 1/1957 | Kamen | 204/112 |
| 3,005,683 | 10/1961 | Rimshaw | 423/50 |
| 3,891,741 | 6/1975 | Carlin et al. | 423/2 |
| 3,928,153 | 12/1975 | Gendron et al. | 204/112 |
| 4,148,631 | 4/1979 | Babjak et al. | 75/101 BE |
| 4,162,231 | 7/1979 | Howritz et al. | 252/301.1 |
| 4,162,296 | 7/1979 | Muller et al. | 423/139 |
| 4,196,076 | 4/1980 | Fukjimoto et al. | 210/21 |
| 4,299,724 | 11/1981 | Stana | 252/348 |
| 4,395,315 | 7/1983 | Zambro | 204/112 |
| 4,407,725 | 10/1983 | Allen et al. | 502/25 |
| 4,442,071 | 4/1984 | Lieber et al. | 423/10 |
| 4,476,099 | 10/1984 | Camp et al. | 423/10 |
| 4,528,165 | 7/1985 | Friedman | 423/10 |
| 4,624,703 | 11/1986 | Vanderpool et al. | 75/101 R |
| 4,654,173 | 3/1987 | Walker et al. | 423/50 |
| 4,656,011 | 4/1987 | Garraway et al. | 423/10 |
| 4,764,352 | 8/1988 | Bathellier et al. | 423/10 |
| 4,808,384 | 2/1989 | Vanderpool et al. | 423/21.1 |
| 4,818,503 | 4/1989 | Nyman et al. | 423/10 |

OTHER PUBLICATIONS

Lowenheim, F., "Modern Electroplating", 3rd Edition, John Wilby & Sons, 1974, pp. 287-289.

*Primary Examiner*—John Niebling
*Assistant Examiner*—Kishor Mayekar
*Attorney, Agent, or Firm*—J. C. Valentine

[57] ABSTRACT

Technetium is separated from nickel by electro-refining contaminated nickel. Electrorefining controls the electrolyte solution oxidation potential to selectively reduce the technetium from the metallic feedstock solution from Tc(VII) to Tc(IV) forcing it to report to the anodic slimes and thereby preventing it from reporting to the cathodic metal product. This method eliminates the need for peripheral decontamination processes such as solvent extraction to remove the technetium prior to nickel electrorefining. These methods are particularly useful for remediating nickel contaminated by radiocontaminants such as technetium and actinides.

20 Claims, 2 Drawing Sheets

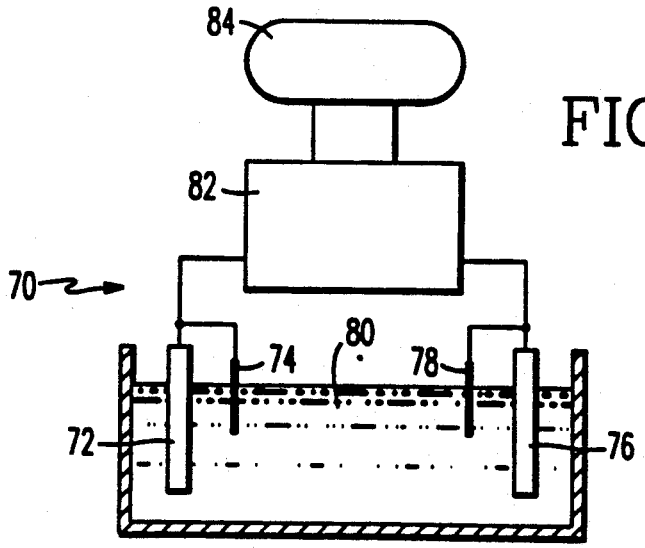
FIG. 2
FIG. 3
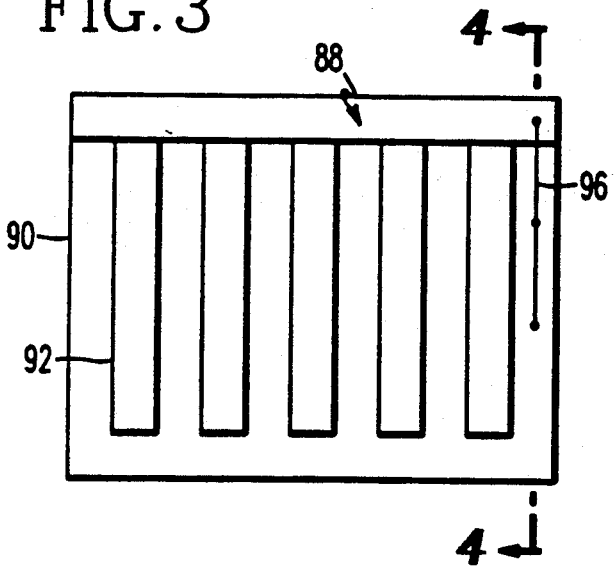
FIG. 4
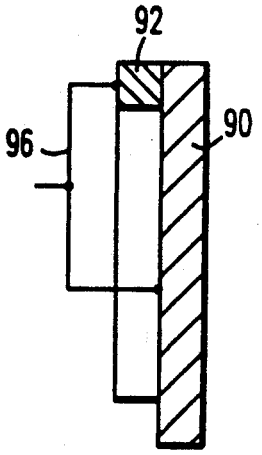
FIG. 5
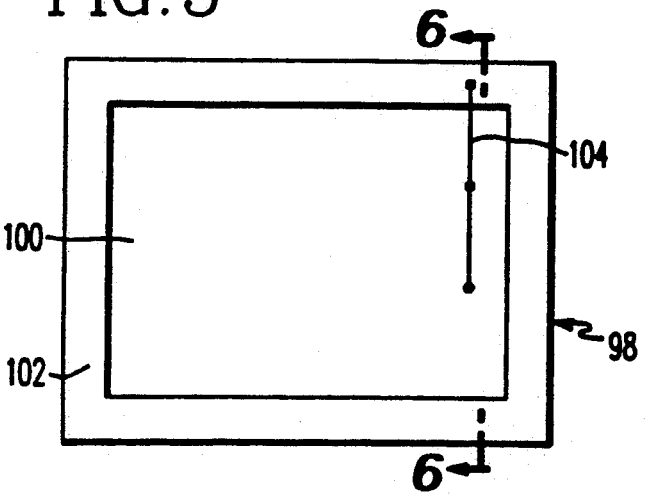
FIG. 6
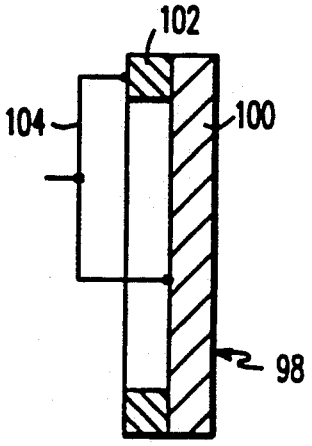

DECONTAMINATION OF RADIOACTIVE METALS

REFERENCE

This is a continuation-in-part application based upon pending U.S. Ser. No. 07/506,044, filed Apr. 9, 1990.

BACKGROUND OF THE INVENTION

1. Field of the Invention

The present invention relates to decontamination of radio-contaminated metals, and in particular to decontamination of radio-contaminated metals by reductive electrochemical processing. Of particular interest to the present invention is the remediation of radio-contaminated nickel from decommissioning uranium gas diffusion cascades in which nickel is the primary constituent. However, the decontamination art taught herein applies equally well to the recovery and decontamination of other multivalent, strategic metals which can be electrowon such as copper, cobalt, chromium, iron, zinc and like transition metals.

2. The Prior Art

The radiochemical decontamination art is presented with unique practical problems not shared with traditional extraction technologies. Radiochemical extraction technologies are generally concerned with the economic recovery of "product radiochemicals". Routine process inefficiencies which permit residual amounts of radiochemicals to remain in process streams or in by-products raise only normal economic issues of process yield and acceptable process costs. The various process streams and the product radiochemicals are used and will continue to be held by the regulated nuclear community so that deminimus release to the general public is not a concern. In stark contrast with these extraction technologies, the presence of only residual parts per million concentrations of fission daughter products such as technetium in remediated nickel and other like recycled products will so degrade product quality of remediated products that their release to unregulated non-nuclear markets is prevented. Degraded product must then either be employed in less valuable regulated nuclear markets or be reworked at great financial cost.

The sources of radio-contamination in diffusion barrier nickel in particular include uranium with enrichment levels above natural levels (usually about 0.7%) and reactor fission daughter products, such as Tc, Np, Pu, and any other actinides. For example, contaminated nickel may have an activity due to technetium of up to about 5000 Bq/gm or more, which is at least an order of magnitude above the maximum international release criteria of 74 Bq/gm metal total activity. Certain countries have specified an even lower criteria of 1.0 Bq/gm or less total activity. If the total activity of a metal exceeds the release criteria, then it is subject to government control for the protection of the public.

Various decontamination processes are known in the art, and specifically for decontamination of nickel. Nickel can be removed by selectively stripping from an acidic solution by electrowinning. See U.S. Pat. No. 3,853,725. Nickel may also be removed by liquid-liquid extraction or solvent extraction. See U.S. Pat. Nos. 4,162,296 and 4,196,076. Further, various phosphate type compounds have been used in the removal of nickel. See U.S. Pat. Nos. 4,162,296; 4,624,703; 4,718,996; 4,528,165 and 4,808,034.

It is known that metallic nickel, contaminated with fission products, can be decontaminated to remove any actinides present by direct electrochemical processing based on the differences in reduction potential in the electromotive force (emf) series. Actinide removal is favored by two phenomena during electrochemical plating. Actinides have a significantly higher reduction potential relative to nickel and they are normally won from molten salt electrolyte rather than from aqueous electrolyte. See U.S. Pat. Nos. 3,928,153 and 3,891,741, for example. Other electrolytic processes are disclosed by U.S. Pat. Nos. 3,915,828; 4,011,151; 4,146,438; 4,401,532; 4,481,089; 4,537,666; 4,615,776 and 4,792,385.

While the removal. of uranium and other actinides has been generally addressed by electrorefining, the removal of technetium has continued to be a substantial problem. When nickel is refined by standard art in a sulfate electrolyte solution, the technetium had been found to track the nickel and codeposit on the cell cathode. Thus, e.g., experiments employing aqueous sulfuric acid solutions at a pH of 2–4 at room temperature have shown that the technetium activity of the deposited metal may be as high as the technetium activity of the feedstock. Thus, e.g., product activity levels as high as about 24,000 Bq/gm may result from electrorefining feedstocks with initial activity levels of the order of about 4000 Bq/gm.

Accordingly, there remains a need for an economical and efficient method to decontaminate metals and more specifically, to separate technetium from these metals in a simple manner.

SUMMARY OF THE INVENTION

The present invention meets the above described needs by reductive electrochemical processing. In the practice of the present invention, technetium radiocontaminants are extracted from radiocontaminated metal by dissolving the metal and the radioactive technetium in an aqueous solution to produce an electrolyte solution containing pertechnetate ions and metal ions, reducing the pertechnetate ions to a technetium oxide precipitate, and cathodically depositing the metal from the solution.

The practice of the present invention favors using a reducing acid such a hydrochloric for an aqueous electrolyte. Other reductants such as ferrous, stannous, chromous, cuprous, titanous, vanadous or other multivalent metal reductants, $H_2S$, CO, hydrogen or other gaseous reductants may be added to reduce the technetium in the aqueous solution from the heptavalent state to the tetravalent state (i.e., from pertechnetate ions, which may be complex ions, to a technetium oxide precipitate). The tetravalent technetium is precipitated to substantially prohibit technetium transport to the cathode. Substantially radio-free metal is recovered at the cathode.

In a preferred practice of the present invention a multivalent metal ion is added as a pertechnetate reductant which, when in a high valence state after reducing the pertechnetate ions, may be reduced at the cell cathode to a lower valence state without depositing on the cathode in the metallic state. Advantageously, such a reductant may be regenerated in the cell and a more pure cathode metal recovered. Preferred multivalent metal ions are titanous and vanadous ions where nickel is recovered in a cell.

In another preferred practice of the present invention a reductant is added to the aqueous solution and the technetium oxide precipitate is separated therefrom externally of the cell. The separated aqueous solution is then introduced into the cell. Advantageously, the residence time of the precipitate in the solution may be closely controlled so that the precipitated technetium oxide will not redissolve as a complex ion in the aqueous solution. Preferably the reductant is continuously added to the aqueous solution and, most preferably, continuously separated from the solution.

In another preferred practice of the present invention a multivalent metal ion in a low valence state is added to the solution as a pertechnetate reductant by applying a voltage between an anode comprised of the multivalent metal and the cell cathode. Advantageously, the multivalent metal anode may be located adjacent an anode comprised of the contaminated metal so that the pertechnetate ions may be locally reduced as they form and the transport of complex technetium ions thereby substantially prevented. Preferred multivalent metal ions are iron, tin, copper and like ions where nickel is recovered in a cell.

BRIEF DESCRIPTION OF THE DRAWING

The invention will become more readily apparent from the following description of certain preferred practices thereof shown, by way of example only, in the accompanying drawings, wherein:

FIG. 2 is a schematic representation of a beaker cell having a contaminated anode and a reductant anode;

FIG. 3 is a front view of a dual anode structure, which may be employed in the cell of FIG. 1;

FIG. 4 is a right section view of the dual anode of FIG. 3;

FIG. 5 is a front view of a second dual anode structure, which may be employed in the cell of FIG. 1; and FIG. 6 is a right section view of the dual anode of FIG. 5.

DETAILED DESCRIPTION OF THE PREFERRED EMBODIMENTS

Figure 1:
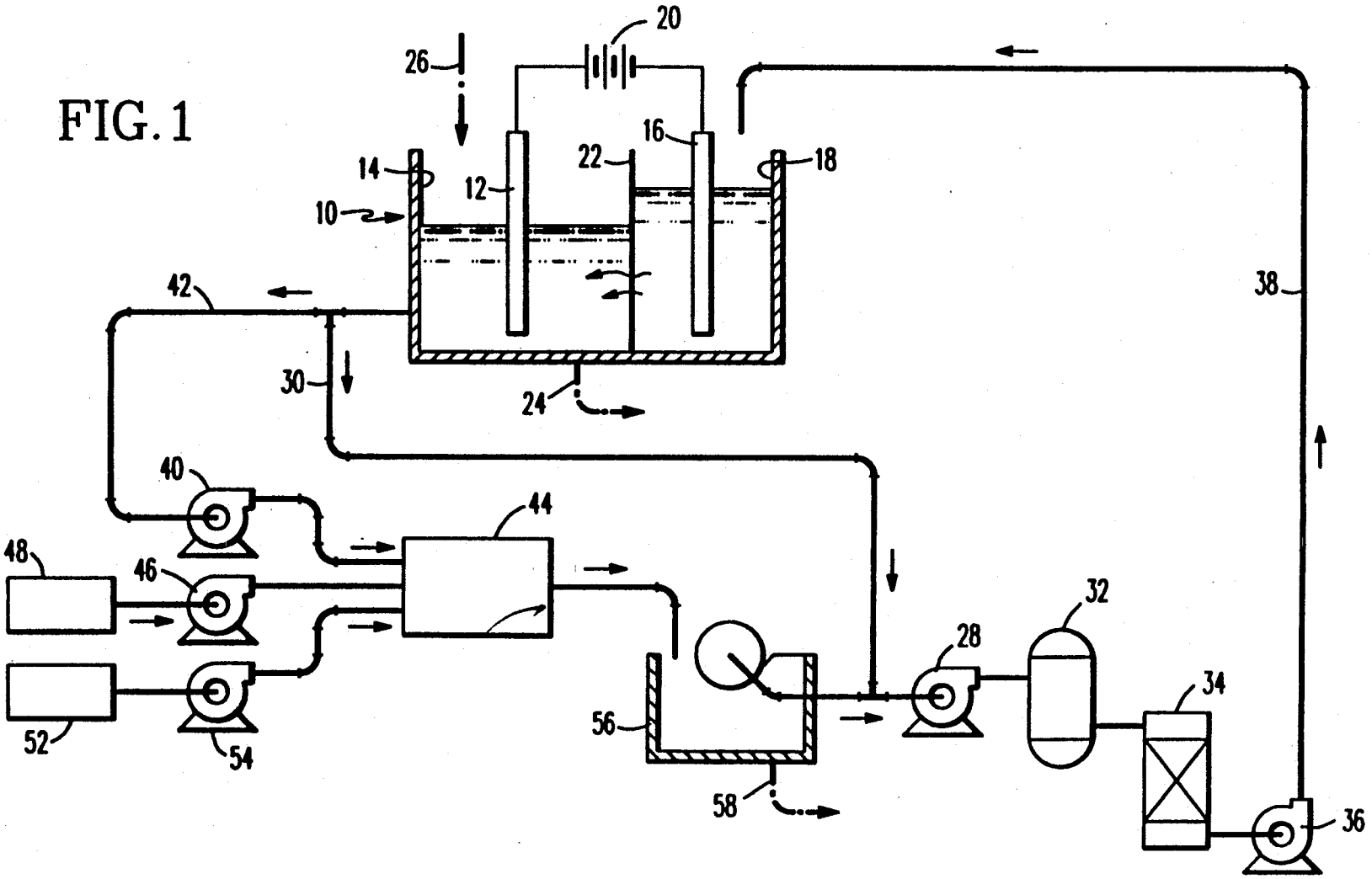
FIG. 1 is a schematic representation of an electrochemical cell which may be employed in the practice of the present invention.

As used herein the term metal shall mean any heavy metal including nickel, iron, cobalt, zinc, like transition metals and other metals which can be electro-won. Nickel shall be generally used as an example for convenience.

The method of the present invention controls the anolyte oxidation potential to adjust the technetium valence from the heptavalent state to the tetravalent state rather than plating, i.e. depositing, from the heptavalent state obtained naturally during dissolution. Thus, the technetium is reduced from Tc(VII) to Tc(IV) in the anolyte solution to eliminate it from the cathodic product. This improved decontamination method eliminates the need for peripheral decontamination processes which generate secondary process waste such as solvent extraction and/or ion exchange to remove the radio contaminants, and the carbon absorption to remove any residual organic from the electrolyte (completely) prior to the nickel electrorefining stage. The reductive electrorefining method allows technetium and other radio contaminants to be removed in the course of the electrorefining step and also allows cathodic grade, substantially radiochemical-free nickel to be recovered in a single electrorefining step.

Using the standard electrochemical reduction potential series under normal electrorefining cell operating conditions, the nickel half-cell reactions are given by reactions 1 and 2 (referenced to a hydrogen reduction potential of 0 volts):

$$1)\ \text{Anode}\quad Ni - 2e^- \longrightarrow Ni(ii) \qquad E = +0.23\ \text{volts}$$

$$2)\ \text{Cathode}\quad Ni(II) + 2e^- \longrightarrow Ni_{Metal} \qquad E = -0.23\ \text{volts}$$

Controlling pH, temperature and anolyte oxidation potential, metallic nickel is won at the cathode.

The apparent half-cell reactions for the electrorefining of metallic technetium are shown in equations 3 and 4. However, neither the reported behavior of technetium in the nickel circuit nor the mode of plating technetium free nickel are obvious from these reactions:

$$3)\ Tc + 4H_2O - 7e^- \longrightarrow TcO_4^- + 8H^+ \qquad E^\circ = -0.472$$

$$4)\ TcO_4^- + 7e^- + 8H^+ \longrightarrow Tc + 4H_2O \qquad E^\circ = +0.472$$

Further, direct experience with this system in the absence of the technetium valence reduction step teaches that technetium will track nickel directly to the cathode; the process being driven largely by the overpotential generated in typical, commercial electrochemical cells.

Nickel electrorefining conditions employing a reducing acid (preferably aqueous solutions hydrochloric acid) reduces technetium in the feedstock solution starting at the dissolution anode. Although the complete mechanism of the technetium (VII) reduction and precipitation as $TcO_2$ is not clear, technetium-free nickel is recovered by electrochemical means from radio-contaminated feedstocks. Equations (5) and (6) potentially describe the half-cell reactions that allow $TcO_2$ precipitation without influencing nickel recovery at the cathode. In a highly concentrated nickel solution (particularly in a chloride electrolyte in which nickel forms no chloride complexes but remains as bare nickel (II)), one possible pertechnetate complex can be formed in hydrochloric acid solutions which is positive:

$$[(TcO_4)^- \cdot XNi^{+2}]^{2x-1}$$

Not only does this complex provide a positive charge which would be attracted to the cathode but, if x equals 1 or 2, then it would explain why technetium concentrates in the cathodic nickel product relative to the technetium contaminated level in the nickel feedstock. Note also that cationic technetium complexes can form as well. In a strongly oxidizing acid, technetium, present either as pertechnetate ion complex or a lower valence positive complex, migrates from anode to cathode during nickel electrorefining where it is reduced chemically with the cathodic nickel product.

| Anodic Reactions in Reducing Electrolyte | Cathodic Reaction in Reducing Electrolyte |
|---|---|
| (5) $Tc - 7e^- + 4H_2O + TcO_4^- + 8H^+$ | $4e^- + 4H^+ \rightarrow 2H_2$ |

-continued

| Anodic Reactions in Reducing Electrolyte | Cathodic Reaction in Reducing Electrolyte |
|---|---|
| (6) $TcO_4^- + 4H^+ + 3e^- \rightarrow TcO_2 + 2H_2O$ | |

The complete electrochemical formation of technetium oxide in solution would force insoluble $TcO_2$ to the precipitate in the slimes at the anode but complete precipitation is unlikely using oxidizing electrolyte conditions because reactions 5 and 6 are difficult to drive to completion in oxidizing media. Further, both the heptavalent technetium state and its pertechnetate ion are quite stable in oxidizing the electrolytes. Therefore, a chemical reduction of technetium must boost the strictly electrochemical behavior to drive reactions 5 and 6 to completion.

A reducing acid such as aqueous hydrochloric acid is preferably substituted by the present invention for the oxidizing acid such as sulfuric acid to promote the formation of technetium oxide by anodic reaction shown in equations 5 and 6. Moreover, the oxidation potential of the electrolyte must be controlled to maintain conditions favoring technetium oxide formation. Further, increasing anodic half cell voltages to greater than or equal to 0.8 volts provides an overall cell voltage of greater than or equal to 1.2 volts to enhance this reaction. Chemical reductants are added to the anodic chamber to enhance technetium valence reduction from VII to IV.

Where chemical reductants are employed, inorganic acids such as sulfuric acid or phosphoric acid may be utilized as an electrolyte solution, but a reducing acid such as hydrochloric acid is preferably employed. Preferred chemical reducing-agents are multivalent metal ions, which may be conveniently provided as metallic chlorides such as $SnCl_2$, $FeCl_2$, $CrCl_3$, $CuCl_2$, $TiCl_2$ and $VCl_2$. These materials reduce technetium (VII) to technetium (IV). Gaseous reducing agents such as carbon monoxide, hydrogen sulfide or hydrogen may be sparged into the solution to drive the technetium reduction. The benefit of the gaseous reductants is that they have no residual solution byproducts to co-reduce with nickel at the cathode and chemically contaminate the nickel metal product. Further, gaseous reductants do not accumulate in the system. In addition, other reducing agents such as hydrazine, hydrazine compounds and hydrophosphites may be employed.

FIG. 1 schematically shows an electrochemical cell 10 which may be employed in the practice of the present invention. The cell 10 has an anode 12 in an anode chamber 14 and a cathode 16 in a cathode chamber 18 which are electrically connected by a voltage source 20. The anode 12 is normally comprised of the metal to be recovered at the cathode 16. The anode chamber 14 and the cathode chamber 18 are separated by a semipermeable membrane 22 which permits the transfer of the electrolytic solution from one chamber to the other chamber. Preferably, the solution is circulated through an external circuit from the anode chamber 14 to the cathode chamber 18 and then back to the anode chamber 14 through the membrane 22. Alternatively, the solution may circulate within the cell 10 between the chambers (not shown). The cell 10 may have a drain line 24 for removing anode slimes, including technetium oxide in some practices, which form in the anode chamber 14. The cell 10 typically operates between about 25 degrees centigrade and about 60 degrees centigrade and at a current density of about 10 to about 300 amps/square foot with an efficiency of about 80% or more at a cell voltage of about 2 to about 4 volts/cell.

The electrochemical cell 10 advantageously may employ any suitable aqueous solution having a pH of from about 1 to about 6 as an electrolytic solution. Preferably a hydrochloric acid solution having a pH of between about 1 and about 4.5 is employed as an electrolyte solution where nickel is to be recovered. Preferably, the solution contains from about 40 to about 105 grams/liter metal. Up to about 60 grams/liter of boric acid or other suitable plating agent may be employed to improve the plating rate and the character of the plating deposit.

Preferably, a reductant is added to an aqueous hydrochloric acid solution in the case where the contaminated metal is nickel or a nickel alloy. Reductants such as $Fe^{+2}$, $Cu^{+2}$, $Sn^{+2}$, $Ti^{+2}$, $V^{+2}$ or other multivalent ions may be advantageously added to the solution in the form of soluble salts such as chlorides, as is indicated by addition arrow 26. Gaseous reductants alternatively may be added by sparging the gases into the hydrochloric acid solution in the anode chamber 14 (not shown).

In a preferred practice of the present invention particularly adapted to substantially reduce the codeposition of the reductant at the cathode, titanium or vanadium ions are added as reductants for nickel. Advantageously, these multivalent metal ions will form cations having a low valence state of +2 which reduce the pertechnetate ions and concomitantly are themselves oxidized to a higher valence state of +3 or +4 in the anode chamber 14. The precipitated technetium oxide generally reports to the anodic slimes. The cations in the higher valence state are reduced from the high valence state to the low valence state in the cathode chamber 18 without cathodically depositing on the cathode 16. Then the reductant may be recirculated to the anode chamber 14 to repeat the cycle. Also, the reductant concentration may be closely maintained within a controlled range with little loss of reductant to the slimes and low volumes of waste may be generated. In addition, a dimensionably stable electrode may be deposited. In practice, deposited cathodes may be subject to scaling or flaking where the reductant is a transition metal which codeposits with the metal to be recovered. Thus the selection of the candidate reductants (such as ferrous, stannous or cuperous ions in the case of nickel) include this consideration.

Preferably the aqueous solution in the anode chamber 14 is pumped from the electrochemical cell 10 via a pump 28 in an external line 30 through a strong base anion exchanger 32 for capturing pertechnetate ions which may not have been reduced or may have been generated. The polished aqueous solution from the anion exchanger 32 flows into a holding tank 34 where the activity of the solution may be continuously analyzed. The solution may then be introduced into the cell cathode chamber 18 via a pump 36 in a line 38.

In another practice of the present invention particularly adapted to remove substantially all of the technetium-containing species from the metal-containing solution in the cathode chamber 18, the aqueous solution in the anode chamber 14 containing pertechnetate ions and metal ions is pumped via a pump 40 in an external line 42 into a pipeline reactor 44 or other substantially plug flow reactor for closely controlling the concentration of added technetium reductants and the residence time of the technetium oxide precipitate in the metal-containing solution. A reductant such as Fe+2, Sn+2 or Cu+2 ions in an aqueous solution may be pumped by a pump 46 from a make-up tank 48 or other suitable source into the reactor 44. In addition, an aqueous suspension of filter aid may be conveniently added from a make-up tank 52 by a pump 54 to the precipitate-containing solution in the reactor 44. The filter aid preferably contains graphite or activated carbon and also a powdered anion exchange resin so that technetium which reoxidizes to the pertechnetate species and goes back into solution may be adsorbed. The suspension flows from the pipeline reactor 44 into a rotary drum filter 56 or other suitable (and preferably continuous) separating device for separating the precipitate and the filter aid from the aqueous solution. The precipitate and filter aid are discharged as a sludge, as is shown by discharge arrow 58. Preferably the residence time of the precipitate in the reactor 44 and in the filter 56 is less than one hour, and more preferably less than about one half an hour. The metal-containing solution is then pumped through the anion exchanger 32 to the cathode chamber 18. Data indicates that the activity of the solution of the metal-containing solution after the anion exchanger 32 will be from about 1% to about 10% of the activity of the solution before the anion exchanger 32.

Beaker tests have shown that the precipitate begins to redissolve as complex ions into the aqueous solution shortly after the precipitate forms. Thus, the anode slimes may be a significant source of technetium contamination in the case where technetium oxide precipitates from the solution inside the cell anode chamber 14. The beaker tests were conducted on hydrochloric acid solutions at a pH of 2 and at a temperature of about 25 centigrade. The solutions generally contained 90 grams/liter nickel and 3000–4000 parts technetium per million (ppm) nickel.

In one series of tests, ten samples of the contaminated solution were each charged with up to 50 grams of ferrous chloride per 50 milliliter of solution or up to 50 grams of stannous chloride per 50 milliliter of solution to precipitate technetium oxide. The samples were not filtered immediately after precipitation. Several weeks were permitted to lapse between precipitation and analysis of the activity and of the technetium concentration of the solutions. The analyses of the samples with initial activities over 4000 Bq/gm charged with ferrous chloride indicated the following concentrations with week long residence times in the filtrates:

| Sample | Grams FeCl2 50 ml Solution | Gram Mol Fe Liter | Tc Activity Bq/g Iron | Conc. Tc ppb |
|---|---|---|---|---|
| 1 | 0.5 | 0.08 | 566 | 908 |
| 2 | 1.25 | 0.2 | 591 | 947 |
| 3 | 2.5 | 0.4 | 386 | 947 |
| 4 | 5.0 | 0.8 | 370 | 620 |
| 5 | 50 | 8.0 | 1910 | 3086 |

The analyses of similar feed samples charged with stannous chloride indicated the following concentrations at long residence times in the filtrates:

| Sample | Grams SnCl2 50 ml Solution | Gram Mole Sn Liter | Tc Activity Bq./g Tin | Conc. Tc ppb |
|---|---|---|---|---|
| 6 | 0.5 | .053 | 257 | 413 |
| 7 | 1.25 | 0.13 | 333 | 535 |

-continued

| Sample | Grams SnCl2 50 ml Solution | Gram Mole Sn Liter | Tc Activity Bq./g Tin | Conc. Tc ppb |
|---|---|---|---|---|
| 8 | 2.5 | 0.263 | 434 | 697 |
| 9 | 5.0 | 0.525 | 528 | 848 |
| 10 | 50. | 5.25 | 837 | 1347 |

This series of tests indicates that reductant concentrations of less than about 5 gram-moles/liter(5 Normal) produce filtrates having low technetium concentrations. Thus the concentration of metal ion reductants such as ferrous and stannous ions is preferably between about 0.05 and about 1 Normal, and more preferably between about 0.05 and about 0.5 Normal, to most effectively precipitate technetium-containing compounds without introducing excessive amounts of cations such as ferrous ions and stannous ions, which may result in unnecessarily high impurity levels in the metal cathode.

In another series of tests, five samples of contaminated solution were each charged with 5 grams of ferrous chloride per 50 milliliter of contaminated solution (such as Sample 4 above). These samples were held for from 0.5 to 6 hours and then filtered. The analyses of the samples indicated the following activity and technetium concentration of the filtrates:

| Sample | Residence Time hours | Activity Tc Bq/g Tin | Conc. Tc ppb |
|---|---|---|---|
| 11 | 0.5 | 10.2 | 16 |
| 12 | 1 | 9.2 | 15 |
| 13 | 2 | 26.9 | 43 |
| 14 | 4 | 20.9 | 33 |
| 15 | 6 | 30.3 | 49 |

A comparison of Samples 11 and 12 with Samples 13–15 indicates that the technetium concentration of the filtrate was substantially less when the residence time was less than about one hour. Thus, the technetium oxide should be precipitated and separated from the aqueous solution within a residence time of about one hour if the redissolution of technetium from the oxide is to be minimized. Preferably, the addition and separation steps are performed continuously to closely control the reductant concentration and to minimize the redissolution of the technetium.

In another practice of the present invention particularly adapted to efficiently reduce the pertechnetate ions as they are anodically dissolved, multivalent metal ions in a low valence state are added to the solution in the anodic chamber by applying a voltage between a secondary anode comprised of the multivalent reductant metal and a cell cathode. Advantageously, the reductant anode may be located near the contaminated anode so that the pertechnetate anions are reduced before they have a substantial opportunity to form more stable complex ions which are not repelled by the cathode and disperse throughout the solution. In addition, the voltage supplied to the reductant anode may be controlled to minimize the addition of excessive amounts of reductant to the solution.

FIG. 2 schematically shows a beaker cell 70 which was employed to demonstrate this practice. The beaker cell 70 of FIG. 2 generally comprised a first pair of electrodes 72 and 74 and a second pair of electrodes 76 and 78 immersed in an electrolytic solution 80. One electrode 72, 76 of each pair was comprised of nickel contaminated with more than 1 ppm technetium. The other electrode 74, 78 of each pair was comprised of iron. The electrodes 72–78 were electrically connected by a reversing switch 82 to a power supply 84.

In the demonstration test, nickel ions and pertechnetate ions were anodically dissolved into an electrolytic solution 80 provided as a 2 Normal hydrochloric acid solution containing 30–60 grams/liter boric acid. The nickel feed activity was over 4000 Bq/gm. The anodic slimes which formed were filtered from the solution and their activities (disintegrations/minute) were analyzed as follows:

| pH | degrees Centigrade | Filtrate DPM | Filtercake DPM |
|---|---|---|---|
| 0 | 25 | — | 2200 |
| 0 | ~60 | — | 2500 |
| 2 | 25 | 1000 | 180000 |
| 2 | ~60 | 800 | 320000 |
| 4 | 25 | 1000 | 280000 |
| 4 | 60 | 500 | 310000 |

Thus this practice may be employed to efficiently reduce the pertechnetate ions to a technetium oxide which may be separated to provide a relatively clean metal-containing filtrate. It is noted that a commercial-type cell having an anode in an anode chamber and a cathode in a cathode chamber would provide an even cleaner filtrate.

FIGS. 3 and 4 show a dual anode structure 88 which may be employed in an electrolytic cell such as the cell 10 of FIG. 1 to reduce the pertechnetate ions to technetium oxide. The dual anode structure 88 as shown has a contaminated metal anode 90 supporting a reductant anode 92, which may be one or more metal strips mounted on the contaminated anode 90 by an electrically insulating cement or fastener (not shown). The anodes 90, 92 may be connected to a power supply (not shown) by electrical conductors 96 or other suitable means. A reductant anode may be located on one side of the contaminated electrode 90 as shown or two or more electrodes may be located on one or both sides of the contaminated electrode (not shown).

FIGS. 5 and 6 show another dual anode structure 98 which may be employed in an electrolytic cell to reduce the pertechnetate ions to technetium oxide. The dual anode structure shown has a contaminated anode 100 supporting a peripheral reductant anode 102, which may be one or more metal strips. The anodes 100, 102 may be connected to a power supply (not shown) by electrical conductors 104 or other suitable means.

A beaker test was conducted without the use of added reductants such as multivalent metal ions, reducing gases and the like to demonstrate the net behavior difference between a hydrochloric acid solution (a reducing environment) and a sulfuric acid solution (a mildly oxidizing environment) in the anodic dissolution of contaminated nickel. Nickel anodes contaminated with about 0.7 ppm technetium were dissolved in 2 Normal acid solutions at about room temperature. The solutions were permitted to sit prior to filtration of the slimes from the solution and analysis of their activities (disintegrations/minute). The analysis indicated the following activities:

| Acid | Filtrate DPM | Sludge DPM |
|---|---|---|
| H2SO4 | 1200 | 1500 |

-continued

| Acid | Filtrate DPM | Sludge DPM |
|---|---|---|
| HCl | 0 | 400 |

Thus, although sulfuric may be employed in the decontamination of metals containing technetium, this test demonstrates that a reducing acid such as hydrochloric acid (and/or another reductant) will more effectively separate the technetium from the solution and thereby permit the cathodically recovered metal to be more completely decontaminated.

Whereas particular embodiments of the invention have been described above for purposes of illustration, it will be appreciated by those skilled in the art that numerous variations of the details may be made without departing from the invention as described in the appended claims.

We claim:

1. A method of extracting technetium from radiocontaminated metal, comprising the steps of:

dissolving metal contaminated with radioactive technetium in an aqueous solution to produce a solution containing pertechnetate ions and metal ions;

reducing the pertechnetate ions to a technetium oxide precipitate; and cathodically depositing metal from the solution.

2. The method of claim 1, wherein the metal and the technetium are dissolved in a hydrochloric acid solution.

3. The method of claim 1, wherein the pertechnetate ions are reduced to a technetium oxide precipitate with a multivalent metal ion in a low valence state.

4. The method of claim 3, wherein the contaminated metal is nickel and the multivalent metal ion is a metal ion selected from the group consisting of $Sn+^2$, $Fe+^2$, $Cu+^2$, $Cr+^2$, $Ti+^2$ and $V+^2$.

5. The method of claim 4, wherein the metal ion is selected from the group consisting of $Sn_+^2$, $Fe+^2$ and $Cu+^2$.

6. The method of claim 4, wherein the metal ion is selected from the group consisting of $Ti+^2$ and $V+_2$.

7. The method of claim 3, wherein the multivalent metal ion is in a high valence state after reducing the pertechnetate, comprising an additional step of:

cathodically reducing the multivalent metal ion to a low valence state without cathodically depositing the reductant.

8. The method of claim 3, comprising as an additional step:

separating the technetium oxide precipitate from the metal-containing aqueous solution externally of an electrochemical cell; and then introducing the separated solution into the cell to cathodically deposit the metal.

9. The method of claim 3, wherein:

the multivalent metal ions are added to the aqueous solution externally of an electrochemical cell to reduce the pertechnetate ions to a technetium oxide precipitate;

the technetium oxide precipitate is separated from the aqueous solution externally of the cell and then the separated aqueous solution is introduced into the cell for cathodically depositing metal from the aqueous solution.

10. The method of claim 9, wherein the contaminated metal is nickel and a metal ion selected from the group consisting of $Fe+^2$ and $Sn+2$ is added to the aqueous solution externally of the cell.

11. The method of claim 10, wherein the metal ion is present in the aqueous solution in a concentration of between 0.05 and about 5N.

12. The method of claim 10, wherein the metal ions are continuously added to the aqueous solution.

13. The method of claim 12, wherein the technetium oxide is continuously separated from the aqueous solution.

14. The method of claim 12, wherein the technetium oxide precipitate has a residence time in the aqueous solution of less than about one hour.

15. The method of claim 3, wherein the multivalent metal ion is added to the aqueous solution at a low valence by applying a voltage between an anode comprised of the multivalent metal and a cathode in an electrochemical cell.

16. The method of claim 15, wherein the contaminated metal is nickel and the aqueous solution has a pH of less than about 2.

17. The method of claim 15, wherein the multivalent metal is iron.

18. The method of claim 1, wherein the pertechnate ions are reduced by a gas selected from the group consisting of CO, $H_2S$ and $H_2$.

19. The method of claim 18, wherein the reductant gas is sparged into the solution in the anode chamber.

20. The method of claim 18, wherein the technetium oxide precipitate is separated from the aqueous solution externally of the cell before the metal is cathodically deposited.

* * * * *